US005787406A

United States Patent [19]

Arsenault et al.

[11] Patent Number: 5,787,406

[45] Date of Patent: Jul. 28, 1998

[54] VALUE DISPENSING MECHANISM, SUCH AS A POSTAGE METER, HAVING AUTOMATIC DISPLAY/PRINTING SELECTION

[75] Inventors: Robert G. Arsenault, Stratford; William F. Bailey, Guilford; William T. Lefebvre, Rocky Hill; Joseph M. Mozdzer, Beacon Falls, all of Conn.

[73] Assignee: Pitney Bowes Inc., Stamford, Conn.

[21] Appl. No.: 764,399

[22] Filed: Dec. 11, 1996

[51] Int. Cl.[6] ..... G07B 17/00

[52] U.S. Cl. ..... 705/410; 101/71; 235/375; 345/333; 705/401; 705/411

[58] Field of Search ..... 101/71; 235/375, 235/380, 381, 382; 340/825.3, 825.31, 825.34, 825.35; 364/464.11, 464.18, 464.2, 464.21; 395/333; 705/401, 408, 410, 411; 345/333

[56] References Cited

U.S. PATENT DOCUMENTS

| | | | |
|---|---|---|---|
| 4,780,601 | 10/1988 | Vermesse | 235/375 |
| 4,802,218 | 1/1989 | Wright et al. | 235/375 X |
| 4,831,554 | 5/1989 | Storace et al. | 364/464.18 X |
| 4,980,542 | 12/1990 | Jackson et al. | 235/375 |
| 5,009,276 | 4/1991 | Raikes et al. | 364/464.21 X |
| 5,434,777 | 7/1995 | Luciw | 364/419.13 |
| 5,471,925 | 12/1995 | Heinrich et al. | 364/464.18 X |
| 5,490,077 | 2/1996 | Freytag | 364/464.15 |
| 5,500,513 | 3/1996 | Langhans et al. | 235/380 |
| 5,602,743 | 2/1997 | Freytag | 364/464.18 |
| 5,651,103 | 7/1997 | Arsenault et al. | 395/117 |

*Primary Examiner*—Edward R. Cosimano
*Attorney, Agent, or Firm*—Steven J. Shapiro; Melvin J. Scolnick

[57] ABSTRACT

A value dispensing mechanism which prints an indication of value includes a portable accounting device which accounts for the printed indication of value; and a terminal including apparatus for printing the indication of value, a display which displays messages related to functions of the value dispensing mechanism, structure for controlling messages displayed on the display and for initiating operation of the printing means to print the indication of value, a storage device for storing a plurality of display options, and apparatus for removably receiving the portable accounting device such that at times when the portable accounting device is received in the receiving apparatus the controlling structure and the portable accounting device are in operative communication with each other to permit operation of the value dispensing mechanism; wherein the portable accounting device includes means for automatically designating at least one of the display options upon insertion of the portable accounting device into the receiving means for at least one of displaying the selected display option on the display and printing the selected display option as at least a portion of the indication of value.

8 Claims, 3 Drawing Sheets

VALUE DISPENSING MECHANISM, SUCH AS A POSTAGE METER, HAVING AUTOMATIC DISPLAY/PRINTING SELECTION

BACKGROUND OF THE INVENTION

The instant invention relates to value dispensing mechanisms and more particularly to value dispensing mechanisms having an external accounting structure which performs transaction accounting and which automatically selects one of a plurality of display/printing options.

Value dispensing mechanisms are well known and as used herein encompass a wide variety of apparatus all of which dispense an indication of value. Examples of typical value dispensing mechanisms include postage meters, kiosks and other types of vending machines including lottery dispensing machines and ticket dispensing machines. Each of the aforementioned devices not only dispense items having an indication of value thereon but typically include some type of accounting structure which accounts for the value that has been dispensed. By way of explanation, and not limitation, the postage meter will be discussed throughout the instant application as a representative preferred embodiment of the claimed invention.

Digital postage meters are well known and typically include a keyboard, display, accounting circuitry, and a printing mechanism. The keyboard and display jointly operate to permit communication between the postage meter operator and the postage meter itself in order to identify the amount of postage to be dispensed. The accounting circuitry includes a plurality of registers which serve the purpose of keeping track of the amount of available postage remaining in the postage meter and for deducting the amount of postage dispensed for an individual transaction from the amount of postage that is available. Additional accounting circuitry registers are used to identify the total amount of postage which has been added to the postage meter over its life, via conventional postage meter recharging systems, as well as the total amount of postage dispensed over the life of the meter.

U.S. Pat. No. 4,802,218 issued to Wright et al. describes a postage meter which utilizes an external accounting system. In the Wright structure instead of the accounting circuitry being contained within the main housing of the postage meter, the accounting system circuitry is contained on a smart card. The smart card is operatively connected to the rest of the postage meter by insertion into a conventional smart card reader. The smart card has its own microprocessor and associated memories which communicate with the rest of the postage meter including the display, keyboard and printing mechanism via the card reader. However, when the smart card is removed from the card reader the remaining structure can no longer function as a postage meter since the smart card itself is the postage meter vault. Incorporating the accounting circuitry of the postage meter in a smart card or similar portable accounting device which is connectable to the metering system permits a great deal of flexibility for the user. That is, a single base terminal having only a printing and display function therein can now be accessed by a plurality of individual card users for dispensing postage while ensuring that only the card which is inserted into the card reader accounts for that specific postage. Accordingly, in a single company with a multitude of departments, each department could be given a smart card accounting vault which would keep track of the amount of postage funds dispensed by that department each time the respective smart card is used. However, only a single transaction terminal is required to accommodate all of the users.

While the above flexibility provides a significant advantage to a multi-departmental company, it also presents other user related problems. For example, many companies find it desirable to have an advertising slogan printed alongside the postage indicia. In a stand alone postage meter without an external accounting system a plurality of advertising slogans can be stored in the meter with a particular one of the advertising slogans being selected by the meter operator for each transaction. Thus, if different departments had different advertising slogans which were associated with their particular department, each time the postage meter was used to print an indicia the user would have to toggle through the advertising display options to ensure that the advertising slogan that they wanted was selected. If they didn't do this, it was possible that no advertising slogan or the last advertising slogan selected by the previous user would be printed with the indicia depending upon the default mode of the postage meter.

The same situation occurs when an external accounting system is used. Each time a user inserts their accounting vault into the meter, they must make sure that the appropriate advertising slogan has been selected. The Applicants of the instant invention have recognized the above deficiency and have taken advantage of the use of the remote external accounting system to overcome the foregoing advertising slogan selection problem. The instant invention makes use of the individual external accounting system modules to automatically identify the desired advertising slogan.

Additionally, the Applicants of the instant invention have recognized that the above problem is not limited to the selection of an advertising slogan but will exist whenever it is desirable to permit the postage meter user the option of selecting from a plurality of graphical displays or a plurality of printing options. For example, assume that the postage metering system discussed above was made available to the general public at a variety of locations such as the local grocery store. In a multilingual neighborhood it is desirable to permit the postage meter user to select between a plurality of language modules so that the postage meter display would display messages in the user's preferred language. By applying the instant invention to the preferred language selection feature the individual user's external postage meter vault can be used to automatically select the preferred language upon insertion into the postage meter.

SUMMARY OF THE INVENTION

It is an object of the instant invention to provide a value dispensing apparatus which utilizes an external accounting device to automatically select at least one of a plurality of display options or one of a plurality of printing images available to the user of the value dispensing apparatus. This object is met by providing a value dispensing mechanism which prints an indication of value and which includes a portable accounting device which accounts for the printed indication of value; and a terminal including apparatus for printing the indication of value, a display which displays messages related to functions of the value dispensing mechanism, structure for controlling messages displayed on the display and for initiating operation of the printing means to print the indication of value, a storage device for storing a plurality of display options, and apparatus for removably receiving the portable accounting device such that at times when the portable accounting device is received in the receiving apparatus the controlling structure and the portable accounting device are in operative communication with each other to permit operation of the value dispensing mechanism; and wherein the portable accounting device includes means for automatically designating at least one of the display options upon insertion of the portable accounting device into the receiving means for at least one of displaying the selected display option on the display and printing the selected display option as at least a portion of the indication of value.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENTS

Figure 1:
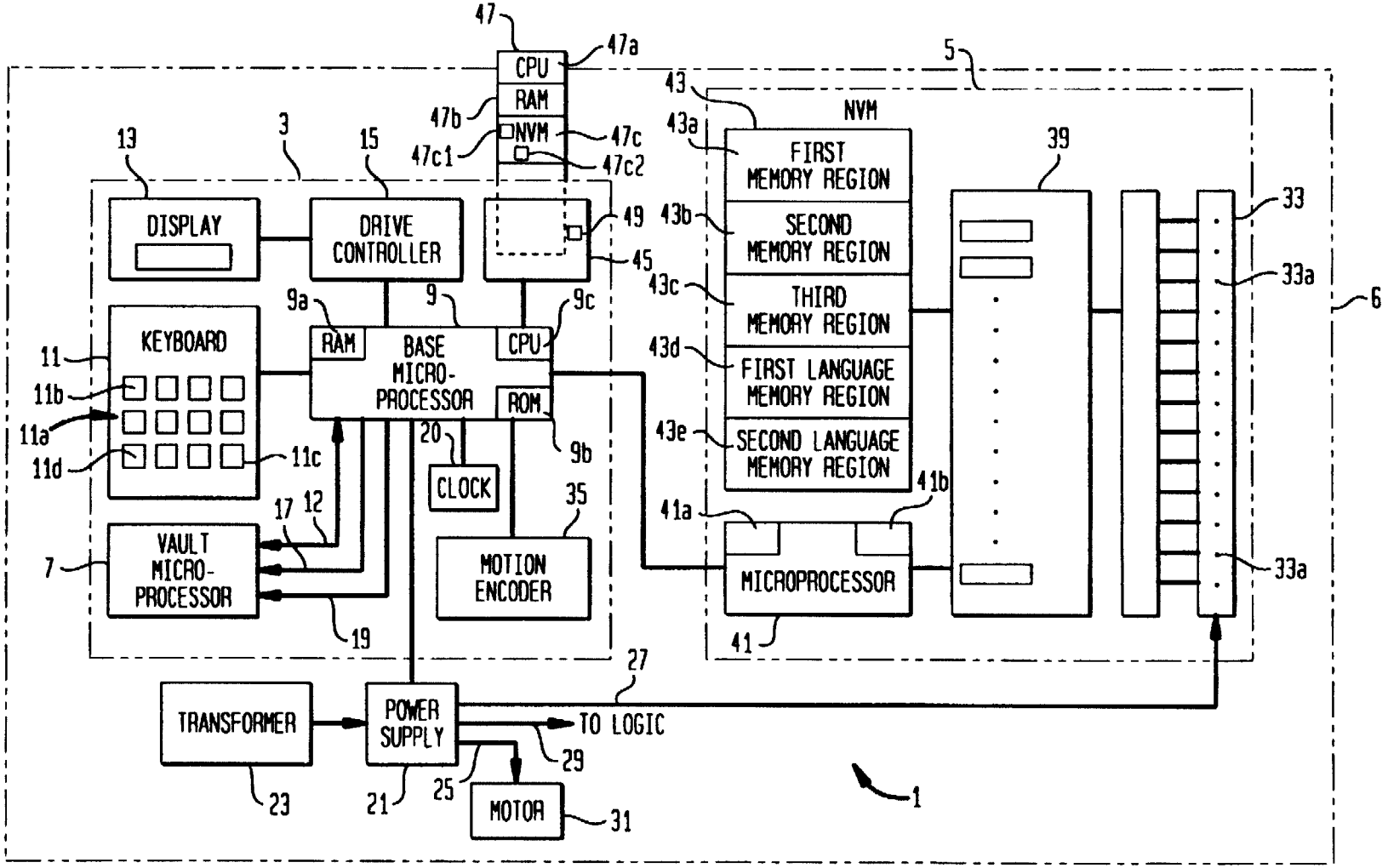
FIG. 1 is a schematic electrical block diagram of a postage meter incorporating the instant invention.
Figure 2:
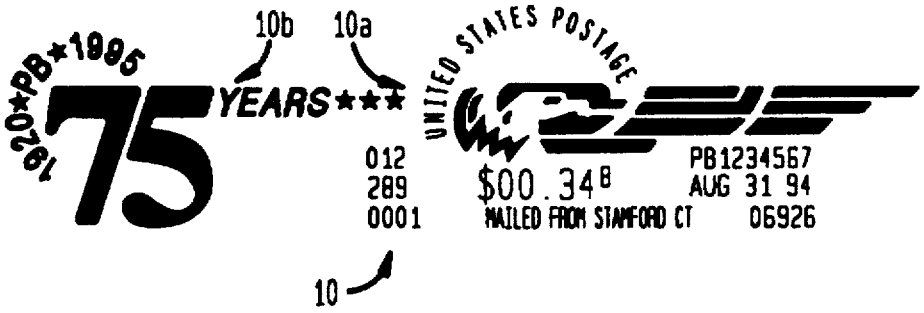
FIG. 2 shows a representative postal indicia image including an advertising slogan and an indicia.

Referring to FIG. 1, postage meter 1 includes two primary modules, a base module 3 and a printhead module 5 each of which are contained within a housing defining a single terminal 6. Base module 3 includes a vault microprocessor 7, which is fixed within the base module 3 and a transaction or base microprocessor 9. Vault microprocessor 7 has software and associated memory to perform the accounting functions of postage meter 1. That is, vault microprocessor 7 has the capability to have downloaded therein, either locally or remotely in a conventional manner, a predetermined amount of postage funds. During each postage transaction, vault microprocessor 7 checks to see if sufficient funds are available. If sufficient funds are available, vault microprocessor 7 debits the amount from a descending register, adds the amount to an ascending register, and sends the postage amount to the printhead module 5 via the transaction microprocessor 9. Transaction microprocessor 9 also sends the date data to the printhead module 5 so that a complete postal indicia image 10, as shown for example in FIG. 2, can be printed on a mailpiece. As used herein, postal indicia image 10 consists of two parts, an indicia 10*a* which includes relevant postal information such as postage amount and date of postage, and an advertising slogan 10*b* which is often desired by the postage meter user for advertising purposes or to display a seasonal greeting such as "Happy New Year".

Vault microprocessor 7 thus manages the postage funds with the ascending register representing the lifetime amount of postage funds spent, the descending register representing the amount of funds currently available, and a control sum register showing the running total amount of funds which have been credited to vault microprocessor 7. Additional features of vault microprocessor 7 which can be included are a piece counter register, encryption algorithms for encoding the information sent to the printhead module 5, and software for requiring a user to input a personal identification number which must be verified by the vault microprocessor 7 prior its authorizing a postage transaction.

Transaction microprocessor 9 acts as a traffic cop in coordinating and assisting in the transfer of information along data line 12 between the vault microprocessor 7 and the printhead module 5, as well as coordinating various support functions necessary to complete the metering function. Transaction microprocessor 9 includes RAM 9*a*, ROM 9*b*, and central processing unit 9*c* to provide for the effective execution of meter operating programs stored in ROM 9*b* to accomplish the meter coordinating functions discussed above. Transaction microprocessor 9 also interacts with keyboard 11 to transfer user information input through keyboard keys 11*a* (such as PIN number, postage amount) to the vault microprocessor 7. Additionally, transaction microprocessor 9 sends data to a liquid crystal display 13 via a driver/controller 15 for the purpose of displaying user inputs or for prompting the user for additional inputs. Moreover, base microprocessor 9 provides power and a reset signal to vault microprocessor 7 via respective lines 17, 19 as well as power and a reset signal to print module microprocessor 41. A clock 20 provides date and time information to transaction microprocessor 9. Alternatively, clock 20 can be eliminated and the clock function can be accomplished by the transaction microprocessor 9.

Postage meter 1 also includes a conventional power supply 21 which conditions raw A.C. voltages from a wall mounted transformer 23 to provide the required regulated and unregulated D.C. voltages for the postage meter 1. Voltages are output via lines 25, 27, and 29 to a printhead motor 31, printhead 33 and all logic circuits. Motor 31 is used to control the movement of the printhead relative to the mailpiece upon which an indicia is to be printed. Base microprocessor 9 controls the supply of power to motor 31 to ensure the proper starting and stopping of printhead 33 movement after vault microprocessor 7 authorizes a transaction.

Base module 3 also includes a motion encoder 35 that processes the movement of the printhead motor 31 so that the exact position of printhead 33 can be determined. Signals from motion encoder 35 are sent to printhead module 5 to coordinate the energizing of individual printhead elements 33*a* in printhead 33 with the positioning of printhead 33. Alternatively, motion encoder 35 can be eliminated and the pulses applied to stepper motor 31 can be counted to determine the location of printhead 33 and to coordinate energizing of printhead elements 33*a*.

Printhead module 5 includes printhead 33, a printhead driver 37, a drawing engine 39 (which can be a microprocessor or an Application Specific Integrated Circuit (ASIC)), a microprocessor 41 and a non-volatile memory 43. NVM 43 includes first 43*a*, second 43*b*, and third 43*c* memory regions. Memory region 43*a* has stored therein image data representative of the fixed portion of the indicia 10*a* (the fixed portion, such as the eagle in indicia 10*a*, is the same for each printed indicia 10*a* as compared to variable indicia data such as the date and postage amount which may change between individual mailpieces). Memory region 43*b* includes the image data for each individual font that may be required as part of the variable data. Memory region 43*c* includes image data for a plurality advertising slogans 10*b* which are selectable by the postage meter user as discussed in more detail below. Memory region 43*d* stores the ASCII character codes which are utilized by display 13 in creating screen displays in a first preferred language. Additionally, in the preferred embodiment, NVM 43 is shown as having a fourth memory region 43*e* which has stored therein the ASCII character codes which are used by dispaly 13 to generate screen displays in a second preferred language which is different from the first preferred language. Thus, the user has the capability of selecting between two different language displays as will be discussed in more detail below. One skilled in the art will recognize that although the preferred embodiment permits selection between two language display modules, any number of language display module options can be incorporated in the system by expanding the necessary NVM storage capacity to accommodate such additions.

In order to select the desired language display, the postage meter operator presses a designated key 11*b* on keyboard 11 until the desired language is displayed on display 13. When the desired language is displayed, the user presses enter key 11*c*. Base microprocessor 9 responds to the pressing of enter key 11*c* and sets a code in a nonvolatile register 41*a* of microprocessor 41 which code identifies which language display memory region 43*d* or 43*e* has been selected. In a similar manner, the postage meter user selects one of the plurality of advertising slogans which can be printed as part of the postal indicia image 10. That is, another key 11*d* is pressed until the desired advertising slogan is identified in display 13. At this point in time enter key 11*c* is pressed and base microprocessor 9 responds to the pressing of key 11*c* by setting a code in register 41*b* which code identifies the appropriate advertising slogan image in memory region 43*c* which is to be printed. Once the codes for the language module selection and the advertising slogan are respectively set in registers 41*a* and 41*b*, they become the default operating mode of postage meter until new selections are made through the keyboard 11.

In operation, microprocessor 41 provides the contents of register 41*a* to drawing engine 39 which retrieves the preferred language ASCII character codes from either memory region 43*d* or 43*e* depending on the language selected. The language codes are sent via microprocessor 41 to transaction microprocessor 9 which in turn provides the display image data to drive controller 15 for displaying messages in the selected preferred language on display 13. Once the user enters the desired postage amount through keyboard 11 and the postage meter 1 has authorized the transaction by ensuring there is enough postage in the vault microprocessor 7 to cover the requested postage amount, microprocessor 41 receives a print command, the desired postage amount, and the date from transaction microprocessor 9. The postage amount and date are sent from microprocessor 41 to the drawing engine 39 together with the advertising slogan code stored in register 41*b*. Drawing engine 39 then accesses non-volatile memory 43 to obtain the necessary fixed, variable and ad slogan image data therefrom which data is then downloaded by the drawing engine 39 to the printhead driver 37 in order to energize individual printhead elements 33*a* to produce a single column dot pattern of the indicia. The individual column-by-column generation of the indicia is synchronized with movement of printhead 33 until the full postal indicia image 10 is printed on the mailpiece. The code stored in register 41*b* identifies which of the plurality of advertising slogans is to be printed. U.S. patent application Ser. No. 08/554,179 entitled MAIL HANDLING APPARATUS AND PROCESS FOR PRINTING AN IMAGE COLUMN-BY-COLUMN IN REAL TIME and filed on Nov. 5, 1995 now issued as U.S. Pat. No. 5,651,103 describes the structure for image generation and is incorporated herein by reference.

While the above description was directed to a meter having only an internal microprocessor vault 7, it is highly desirable, as previously discussed, to provide a dual vault capability. That is, postage meter 1 also includes a conventional card reader 45 which is used to interface with a smart card 47 to permit communication between smart card 47 and transaction microprocessor 9. Smart card 47 is a conventional microprocessor card including a central processing unit 47*a*, RAM 47*b*, and nonvolatile memory 47*c*. Smart card 47 is easily inserted into and out of card reader 45. The use of an external smart card 47 which provides the same accounting functionality as vault microprocessor 7 provides the postage meter user with a great deal of flexibility. That is, different departments or operating units can be provided with individual smart card vaults 47 which are utilized to account for the postage utilized by that department. However, only a single metering system terminal 6 (all of the structure of FIG. 1 except the smart card vault 47) is required to print postal indicia images 10 for each department. Accordingly, all departments can go to a central location to print postage while having individualized accounting. In prior postage meters having a single vault/accounting structure only the total of all transactions at the individual meter were accounted for and there was no capability for individual department accounting.

In addition to the above, the inventive postage meter system can operate without the vault microprocessor 7 such that the postage printing function can only occur when an external smart card vault 47 is inserted into card reader 45. Alternatively if the vault microprocessor 7 remains in the postage meter 1, a switch 49 detects the presence of the smart card 47 and sends a signal to transaction microprocessor 9 to indicate that such is the case. Transaction microprocessor 9 is programmed such that upon receipt of the signal it effects operation of the postage meter 1 utilizing smart card vault 47 and not vault microprocessor 7. Therefore any transaction which occurs with smart card vault 47 inserted into card reader 45 will be accounted for in the accounting registers of smart card 47 and not the registers of vault microprocessor 7. However, if smart card 47 is removed from card reader 45, all transactions will be accounted for in vault microprocessor 7.

While the dual vault structure provides the above-discussed user flexibility, it also presents a user interface problem. That is, registers 41*a* and 41*b* are coded based on the last user operation to identify a specific preferred language display and a particular advertising slogan 10*b* to be printed. Thus, if a user inserts their smart card vault 47 into card reader 45, the default language displayed may not be understandable to the user and they will have to follow the procedure set forth above to select their preferred language display. Moreover, if the user simply enters the desired postage amount without ascertaining which advertising slogan is currently selected via the previously stored code in register 41*b*, the postal indicia image 10 will be printed with the wrong advertising slogan. Since the postage has already been accounted for prior to printing of the indicia, the user would be left with the option of accepting the incorrect advertising slogan or selecting the desired advertising slogan through the keyboard 11, as discussed above, and reprinting the postal indicia image 10 with the correct advertising slogan 10*b*. If the reprinting operation is chosen, the value of the unused indicia 10*a* has been wasted.

Figure 3:
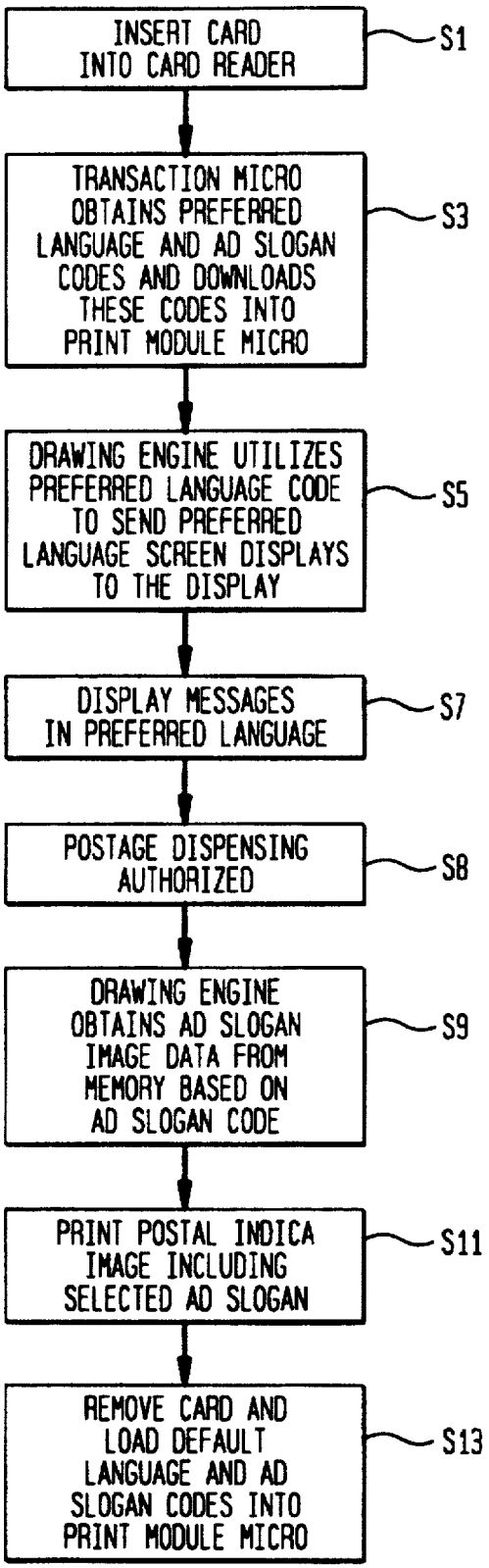
FIG. 3 is a flow chart showing the operation of the postage meter of FIG. 1 for selecting a preferred language and a desired advertising slogan.

FIGS. 1 and 3 will be referred to hereinafter to describe how the applicants overcame the shortcomings of the prior art discussed above. Smart card 47 of the instant invention has first and second registers 47*c*1 and 47*c*2 in NVM 47*c* which are each used to store a respective code identifying the preferred language display and the advertising slogan desired by that particular smart card user. Thus, when smart card 47 is inserted into card reader 45 at step S1, transaction microprocessor 9 obtains the codes from registers 47*c*1 and 47*c*2 and automatically downloads these codes into registers 41*a*, and 41*b* at step S3. Thereafter, microprocessor 41 provides the code from register 41*a* to drawing engine 39 to identify the preferred language module. Subsequently when information is exchanged between the user and the postage meter 1 via keyboard 11 and display 13, transaction microprocessor 9 receives via microprocessor 41 the drawing engine 39 the selected preferred language screen displays which are stored in memory regions 43*d* or 43*e* (step S5) and provides this image data to drive controller 15 so that the preferred language is displayed on display 13 (step S7). Moreover, when printing of a postal indicia image 10 has been authorized (step 8), drawing engine 39 retrieves the image data for desired advertising slogan 10*b* (as identified by the code stored in register 41*b*) from memory region 43*c* (step S9) and sends this image data to printhead driver 39 for printing of the desired indicia image 10 including the selected advertising slogan 10*b* (step S11). Finally, when the transaction is completed and the smart card 47 is removed from card reader 45 base microprocessor 9 loads the default preferred language and advertising slogan codes associated with the last use of the internal vault 7 respectively into registers 41*a* and 41*b* (step S13). The unique structure set forth above ensures that individual smart card vault 47 users will automatically obtain their desired graphical display and advertising slogan upon insertion of the smart card vault 47 into smart card reader 47.

Figure 4:
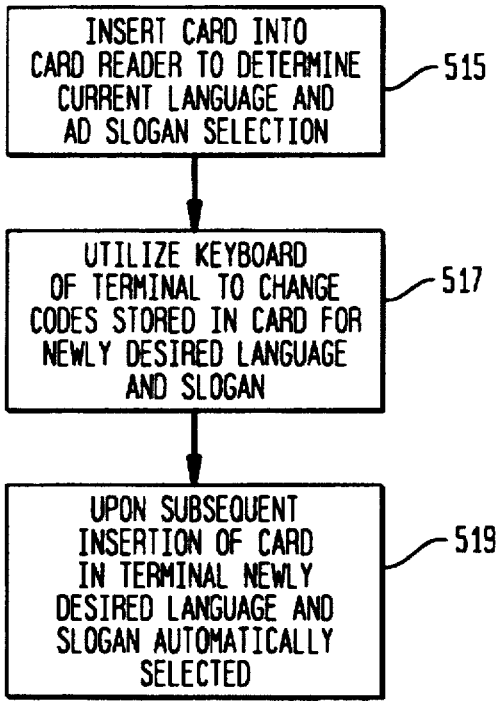
FIG. 4 is a flow chart showing the operation of the postage meter for changing the automatic selection feature of the preferred language and the desired advertising slogan.

A further advantage of the above metering system is that the transaction terminal can be used to change the selection codes stored in registers 47*c*1 and 47*c*2 of smart card 47. With reference to FIG. 4, if a user inserts smart card 47 into card reader 45 and uses either button 11*b* or 11*d* as discussed above, they can ascertain through display 13 the currently selected preferred language and advertising slogans for that smart card 47 (step S15). It is then possible to change these selections by pressing the appropriate buttons 11*b*, 11*c*, and 11*d*, as previously discussed. Once a selection is made, base microprocessor 9 will change the codes stored registers 47*c*1 and 47*c*2 to reflect the newly selected codes (step S17) such that each time the smart card 47 is subsequently used it will automatically select the newly desired preferred language to be displayed and the newly advertising slogan 10*b* to be printed (step S19). Thus, the inventive metering system can be used to initialize or change the preferred language display selection and the advertising slogan selection of the smart card vault 47. This feature is very important because individual smart card vaults 47 can easily be changed and reused by different departments without necessarily requiring that a new smart card vault 47 be obtained.

While the instant invention has been described in connection with a postage meter, the invention is equally applicable to any type of value dispensing device where an item having an indication of value is dispensed and accounting for such value is accomplished. Moreover, while the preferred embodiment set forth above discussed user selected language display preferences and user selected advertising slogan preferences, one skilled in the art will readily recognize that the inventive concepts can be applied to any user selected graphical display or printing image options. Thus, in the instant application, the use of the term "display options" specifically includes both options for a graphical display on a display apparatus or the option of changing the printed image. Additionally, while the external accounting device in the preferred embodiment was a smart card, other types of conventional external devices can be used in lieu thereof. Furthermore, the flash memory device 43 could just as easily be any type of known memory device such as a CD ROM.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims.

What is claimed is:

1. A value dispensing mechanism, which prints an indication of value, comprising:

a portable accounting device which accounts for the printed indication of value; and a terminal including means for printing the indication of value, a display which displays messages related to functions of the value dispensing mechanism, means for controlling messages displayed on the display and for initiating operation of the printing means to print the indication of value, means for storing a plurality of display options, and means for removably receiving the portable accounting device such that at times when the portable accounting device is received in the receiving means the controlling means and the portable accounting device are in operative communication with each other to permit operation of the value dispensing mechanism;

wherein the portable accounting device includes means for automatically designating at least one of the display options upon insertion of the portable accounting device into the receiving means for at least one of displaying the selected display option on the display and printing the selected display option as at least a portion of the indication of value.

2. The value dispensing mechanism as recited in claim 1, wherein the value dispensing mechanism is a postage meter, the portable accounting device is a postage meter vault, the indication of value includes an indicia and an advertising slogan, the plurality of display options is a plurality of different advertising slogans, and the postage meter vault automatically designates a first one of the plurality of different advertising slogans to be printed in the indication of value upon insertion of the postage meter vault into the receiving means.

3. The value dispensing mechanism as recited in claim 1, the plurality of display options is a plurality of different languages in which the messages can be displayed and the portable accounting device automatically designates a first one of the plurality of different languages so that the messages are displayed in the first one of the plurality of different languages.

4. A method of automatically designating one of a plurality of advertising slogan images to be printed as part of a postal indicia image comprising the steps of:

inserting a portable meter vault into a postage meter terminal having means for printing the postal indicia image, means for initiating printing of the postal indicia image by the printing means, and means for storing the plurality of advertising slogan images;

configuring the portable meter vault for automatically designating a desired one of the plurality of advertising slogan images to be printed as part of the postal indicia image upon insertion of the portable meter vault into the postage meter terminal; and printing the postal indicia image to include the desired one of the plurality of advertising slogans based on the automatic designation.

5. A value dispensing mechanism, which prints an indication of value, comprising:

a portable accounting device which accounts for the printed indication of value; and a terminal including means for printing the indication of value, a display which displays messages related to functions of the value dispensing mechanism, means for controlling messages displayed on the display and for initiating operation of the printing means to print the indication of value, means for storing a plurality of display options, and means for removably receiving the portable accounting device such that at times when the portable accounting device is received in the receiving means the controlling means and the portable accounting device are in operative communication with each other to permit operation of the value dispensing mechanism;

wherein the portable accounting device includes means for automatically designating at least one of the display options upon insertion of the portable accounting device into the receiving means for at least one of displaying the selected display option on the display and printing the selected display option as at least a portion of the indication of value;

wherein the value dispensing mechanism is a postage meter, the portable accounting device is a postage meter vault, the indication of value includes an indicia and an advertising slogan, the plurality of display options is a plurality of different advertising slogans, and the postage meter vault automatically designates a first one of the plurality of different advertising slogans to be printed in the indication of value upon insertion of the postage meter vault into the receiving means;

wherein the terminal further includes a keyboard and means for modifying via the keyboard the designating means to automatically designate a second one of the plurality of different advertising slogans instead of the first one of the plurality of different advertising slogans upon insertion of the postage meter vault into the receiving means.

6. The value dispensing mechanism as recited in claim 5, wherein the postage meter vault is a smart card.

7. A value dispensing mechanism, which prints an indication of value, comprising:

a portable accounting device which accounts for the printed indication of value; and a terminal including means for printing the indication of value, a display which displays messages related to functions of the value dispensing mechanism, means for controlling messages displayed on the display and for initiating operation of the printing means to print the indication of value, means for storing a plurality of display options, and means for removably receiving the portable accounting device such that at times when the portable accounting device is received in the receiving means the controlling means and the portable accounting device are in operative communication with each other to permit operation of the value dispensing mechanism;

wherein the portable accounting device includes means for automatically designating at least one of the display options upon insertion of the portable accounting device into the receiving means for at least one of displaying the selected display option on the display and printing the selected display option as at least a portion of the indication of value;

wherein the plurality of display options is a plurality of different languages in which the messages can be displayed and the portable accounting device automatically designates a first one of the plurality of different languages so that the messages are displayed in the first one of the plurality of different languages;

wherein the terminal further includes a keyboard and means for modifying via the keyboard the designating means to automatically designate a second one of the plurality of different languages instead of the first one of the plurality of different languages upon insertion of the postage meter vault into the receiving means.

8. A value dispensing mechanism, which prints an indication of value, comprising:

a portable accounting device which accounts for the printed indication of value; and a terminal including means for printing the indication of value, a display which displays messages related to functions of the value dispensing mechanism, means for controlling messages displayed on the display and for initiating operation of the printing means to print the indication of value, means for storing a plurality of display options, and means for removably receiving the portable accounting device such that at times when the portable accounting device is received in the receiving means the controlling means and the portable accounting device are in operative communication with each other to permit operation of the value dispensing mechanism;

wherein the portable accounting device includes means for automatically designating at least one of the display options upon insertion of the portable accounting device into the receiving means for at least one of displaying the selected display option on the display and printing the selected display option as at least a portion of the indication of value;

wherein the terminal further includes a keyboard and means for modifying via the keyboard the designating means to automatically designate a second one of the plurality of display options instead of the selected display option upon insertion of the portable accounting device into the terminal.

* * * * *